US010995432B2

(12) United States Patent
Mathota et al.

(10) Patent No.: US 10,995,432 B2
(45) Date of Patent: May 4, 2021

(54) SAFETY GLOVES WITH TEAR AWAY FEATURE

(71) Applicant: Ansell Limited, Richmond (AU)

(72) Inventors: Mathotarallage Amani Rasika Mathota, Kelaniya (LK); Eric Michael Thompson, Central, SC (US); James Hunter Moreland, Central, SC (US); James Patrick Thompson, Pendleton, SC (US); Mario Emanuel Camargo Martinez, Ciudad Juárez (MX); Chamila Jayasundara, Kegalle (LK); Fathimathul Freena, Rabama (LK); Rathnaweera Patabendige Santhushta Rathnaweera, Udugampola (LK)

(73) Assignee: Ansell Limited, Victoria (AU)

( * ) Notice: Subject to any disclaimer, the term of this patent is extended or adjusted under 35 U.S.C. 154(b) by 188 days.

(21) Appl. No.: 16/314,503

(22) PCT Filed: Jun. 28, 2017

(86) PCT No.: PCT/AU2017/000140
§ 371 (c)(1),
(2) Date: Dec. 31, 2018

(87) PCT Pub. No.: WO2018/000016
PCT Pub. Date: Jan. 4, 2018

(65) Prior Publication Data

US 2019/0159534 A1 May 30, 2019

Related U.S. Application Data

(60) Provisional application No. 62/356,139, filed on Jun. 29, 2016.

(51) Int. Cl.
*D04B 1/28* (2006.01)
*A41D 19/015* (2006.01)

(52) U.S. Cl.
CPC ..... *D04B 1/28* (2013.01); *A41D 19/015* (2013.01); *A41D 19/01576* (2013.01); *A41D 2500/10* (2013.01); *A41D 2600/20* (2013.01)

(58) Field of Classification Search
CPC ..... A41D 19/015; A41D 19/01505; A41D 19/04; D04B 1/28; D04B 1/22; D04B 7/34; D04B 7/30; D04B 9/58
See application file for complete search history.

(56) References Cited

U.S. PATENT DOCUMENTS 612,741 A * 10/1898 Longden ..... A41D 19/0062 2/168
4,131,952 A * 1/1979 Brenning, Jr. ..... A41D 19/015 2/124

(Continued)

FOREIGN PATENT DOCUMENTS

CN 104837378 A 8/2015
EP 2572598 A1 3/2013

(Continued)

OTHER PUBLICATIONS

International Search Report dated Sep. 20, 2017 for Application No. PCT/AU2017/000140.

(Continued)

*Primary Examiner* — Danny Worrell
(74) *Attorney, Agent, or Firm* — Moser Taboada

(57) ABSTRACT

Provided among other things is a safety glove for use on a hand with fingers with tear zones comprising: a seamless knitted liner (which can in embodiments substantially forms the glove) knitted throughout a safety zone with same yarn or mix of yarn, wherein one or more orthogonally knitted zones are knitted at a relatively low fabric density, wherein one or more orthogonally knitted zones are knitted at a relatively high fabric density, wherein the high and low density zones are configured to provide a four finger tear (Continued)

susceptibility of about 200 Newtons or less, wherein the safety zone includes the fingers.

17 Claims, 4 Drawing Sheets

(56) References Cited

U.S. PATENT DOCUMENTS

| | | | | |
|---|---|---|---|---|
| 6,155,084 | A * | 12/2000 | Andrews | A41D 13/08 66/174 |
| 6,962,064 | B1 * | 11/2005 | Hardee | A41D 19/0065 2/159 |
| 7,555,921 | B2 * | 7/2009 | Thompson | A41D 19/0096 2/159 |
| 7,908,891 | B2 * | 3/2011 | Thompson | D04B 7/34 66/174 |
| 9,072,326 | B2 * | 7/2015 | Becker | D04B 1/28 |
| 9,554,603 | B2 * | 1/2017 | McCourt | A41D 19/02 |
| 10,709,183 | B2 * | 7/2020 | Kim | D04B 1/28 |
| 2013/0283864 | A1 | 10/2013 | VanErmen et al. | |
| 2015/0173438 | A1 | 6/2015 | Hurlock et al. | |

FOREIGN PATENT DOCUMENTS

| | | | |
|---|---|---|---|
| EP | 2572598 | A1 | 3/2013 |
| JP | S57162315 | U | 10/1982 |
| KR | 10-0811863 | B1 | 3/2008 |
| KR | 20140079149 | A | 6/2014 |
| KR | 10-1433934 | B1 | 8/2014 |

OTHER PUBLICATIONS

Supplementary European Search Report on application No. 17818722.5 dated Oct. 31, 2019.

* cited by examiner

SAFETY GLOVES WITH TEAR AWAY FEATURE

The present application relates generally to tear-away gloves for use with potentially dangerous rotating machinery.

Workers operating machinery use gloves to help with grip, and to provide padding. However, rotating machinery poses a danger to workers wearing gloves, since the material of the gloves can be caught in the machinery and pull the glove and enclosed hand into the machinery. Thus, there is a need for work assisting gloves that tear off to release the hand, instead of pulling the user's hand into the machinery.

U.S. Pat. No. 9,072,326 describes a glove where there is a thin "pre-determined tearing zone" that is "processed continuously" with a weak yarn, and rest is processed with a stronger yarn. Thus, the pre-determined tearing zone is made solely with the weak yarn, and the stronger yarn is used outside the tearing zone.

Applicant has now discovered that substantially the same propensity to tear away can be obtained without use of a relatively weaker yarn or yarn mix in one region. The same yarn or mix of yarns can be used in all zones of the glove that are most subject to being caught in rotating machinery. Instead, the level of plating or fabric density can be varied. It happens that while the fabric in low density zones is substantially uniform, tearing tends to happen at the junctions with the denser zones.

SUMMARY

This invention described herein is of safety gloves, and method of use thereof. Various advantages, aspects, and features of the present disclosure, as well as details of illustrated embodiments thereof, will be more fully understood from the following description and drawings. The foregoing summary is not intended, and should not be contemplated, to describe each embodiment or every implementation of the present invention. The Detailed Description and exemplary embodiments therein more particularly exemplify the present invention.

DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only illustrative embodiments of this invention and are therefore not to be considered limiting of its scope, for the invention may admit to other equally effective embodiments.

Figure 1:
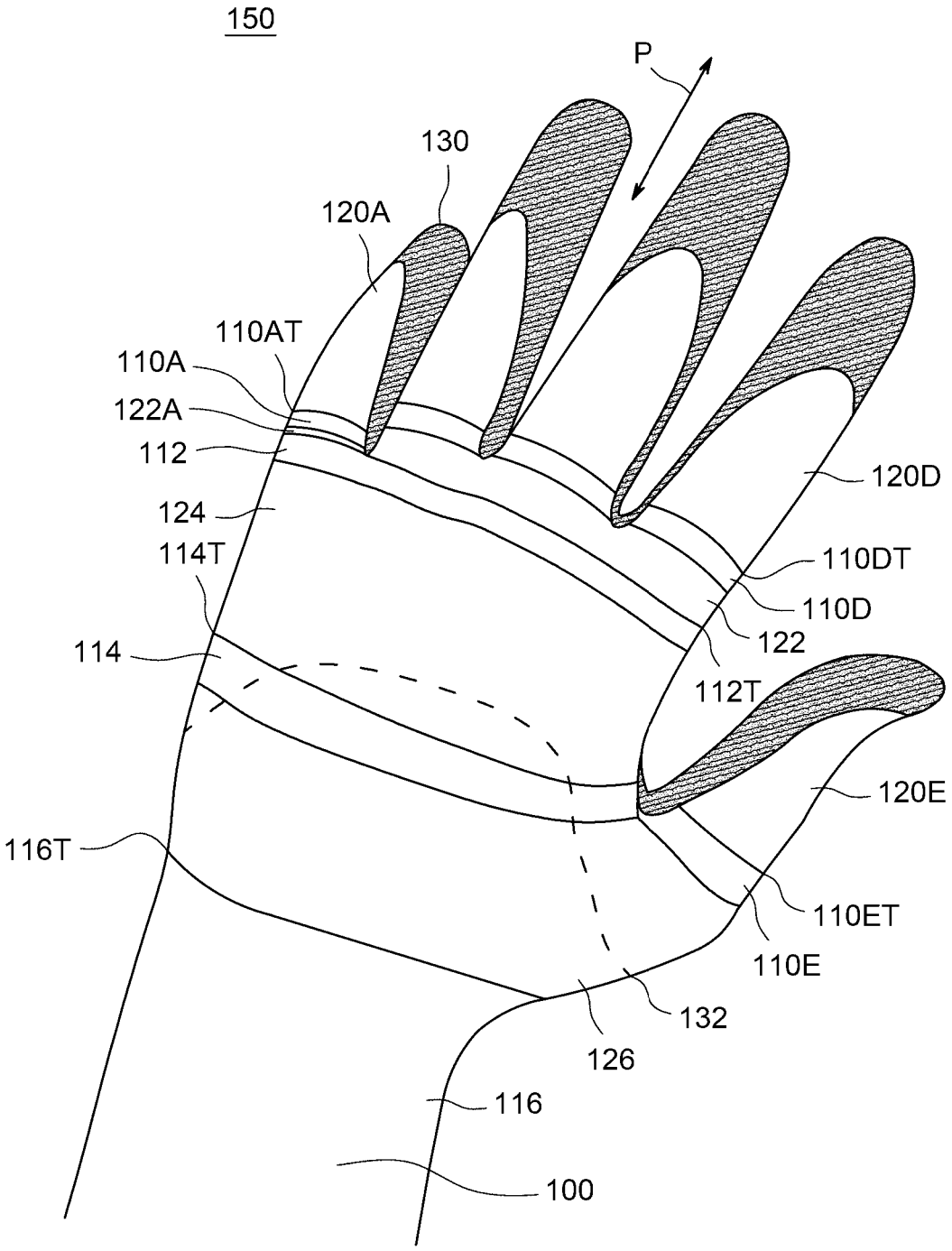
FIG. 1 depicts an embodiment of the invention.

To facilitate understanding, identical reference numerals have been used, where possible, to designate comparable elements that are common to the figures. The figures are not drawn to scale and may be simplified for clarity. It is contemplated that elements and features of one embodiment may be beneficially incorporated in other embodiments without further recitation.

DETAILED DESCRIPTION

Figure 3:
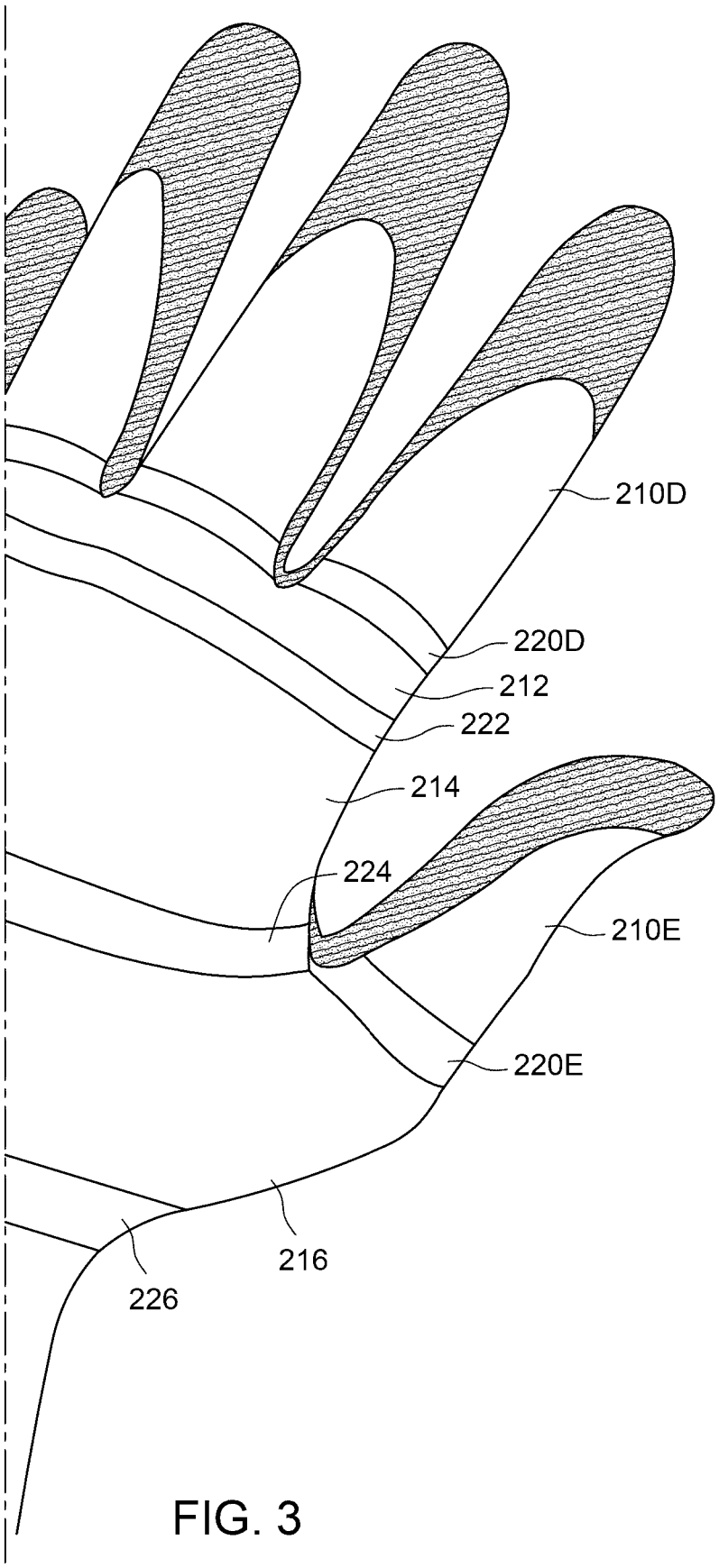
FIG. 3 illustrates another embodiment of the invention.

FIG. 1 shows an illustrative embodiment of the glove of the invention, from a dorsal perspective. The glove 150 is fitted on a human hand and wrist 100, and is based on a plaited-knitted liner. The plating axis for the knitting is typically substantially orthogonal to the axis of the hand, as illustrated by axis P. One of skill will recognize that the features shown on the dorsal side are replicated on the palmar side. What is substantially orthogonal will be recognized by those of ordinary skill as an axis that is consistent with knitting of the zones described below. While this embodiment shows the fabric density as high in the slender stripes (zones 110A-D, 112, 114), such slender strips can instead be zones with low density fabric, as illustrated in FIG. 3 (zones 220A-E, 222, 224, 226).

For convenience in describing the glove, the tip of the glove (at the tips of fingers II through V (index to pinky)) is the top, and the wrist region is the bottom.

Zones 120A to 120E are tear susceptible and are knitted at a low fabric density with yarn to provide for tear away pursuant to one of the tear-away measures described below. Fabric density in such regions can be, for example, about 125 gram per square meter to about 175 gsm, such as about 150 gsm.

Zones 122, 124 and 126 can also be tear susceptible and are plated at a loose plating with the same yarn.

Zones 110A to 110E are tear resistant and are knitted with the same yarn at a higher fabric density. Fabric density in such regions can be, for example, about 350 gram per square meter to about 410 gsm, such as about 380 gsm.

Typically, such a tear resistant zone includes courses where two or more presentations of the yarn are plaited (e.g., double, triple plaiting; i.e., using two or more yarn ends), providing higher fabric density.

Tear susceptible zones are capped (going down from fingertip to wrist) by tear resistant zones consistent with the description above. Tearing tends to occur near boundaries (e.g., tear boundaries 110AT to 110ET) between tear susceptible and tear resistant zones.

Zones 112, 114 and 116 can be tear resistant zones. In embodiments, zone 116 (the cuff) is made with a different yarn.

In embodiments, one or more tear resistant zones starting from the top going down are relatively thin in this dimension (finger to wrist dimension). With the illustrated embodiment of FIG. 1, if three such zones are relatively thin, then all three of the zones in the top region are thin. Or, if two such zones, then both topmost zones are thin. For example, the zones are about 8 mm or less in width, such as about 6 mm or less in width.

The gloves include sufficient tear boundaries to protect the fingers. These can be for example tear boundaries 110AT to 110ET or tear boundaries 112T and 110ET. In a preferred embodiment, the gloves include tear boundaries 110AT to 110ET and 112T (the latter located on the dorsal side near the knuckles and symmetrically on the palmar side). This latter embodiment provides double tear boundaries configured to protect fingers II to V (excluding the thumb, I), and a tear boundary configured to protect the thumb.

In the illustrated embodiment, tear resistant zone 114 has some plating continuity with tear resistant zone 110E, though zone 114 can be located differently, or can be absent.

In embodiments, the glove has double tear boundaries configured to protect fingers II to V, a tear boundary configured to protect the thumb, and one or more tear boundaries encircling a metacarpal (which can be sans the thumb) or carpal region of the hand. This is as illustrated in FIG. 1.

In embodiments, the knitting pattern in the tear susceptible zones is uniform. In embodiments, the knitting pattern in the tear resistant zones is uniform. In embodiments, a single type of yarn is used.

The portion of the glove having tear boundaries, always including the fingers, and optionally including further tear boundaries in the sections from the fingers to the wrist, is termed the "safety zone."

In embodiments, the glove can have a laminated polymer coating such as coating 130, which is a palm coating. The coating can be a ¾ coating, as illustrated by boundary 132, or a full coating (including encircling at least a portion of the wrist).

Figure 2:
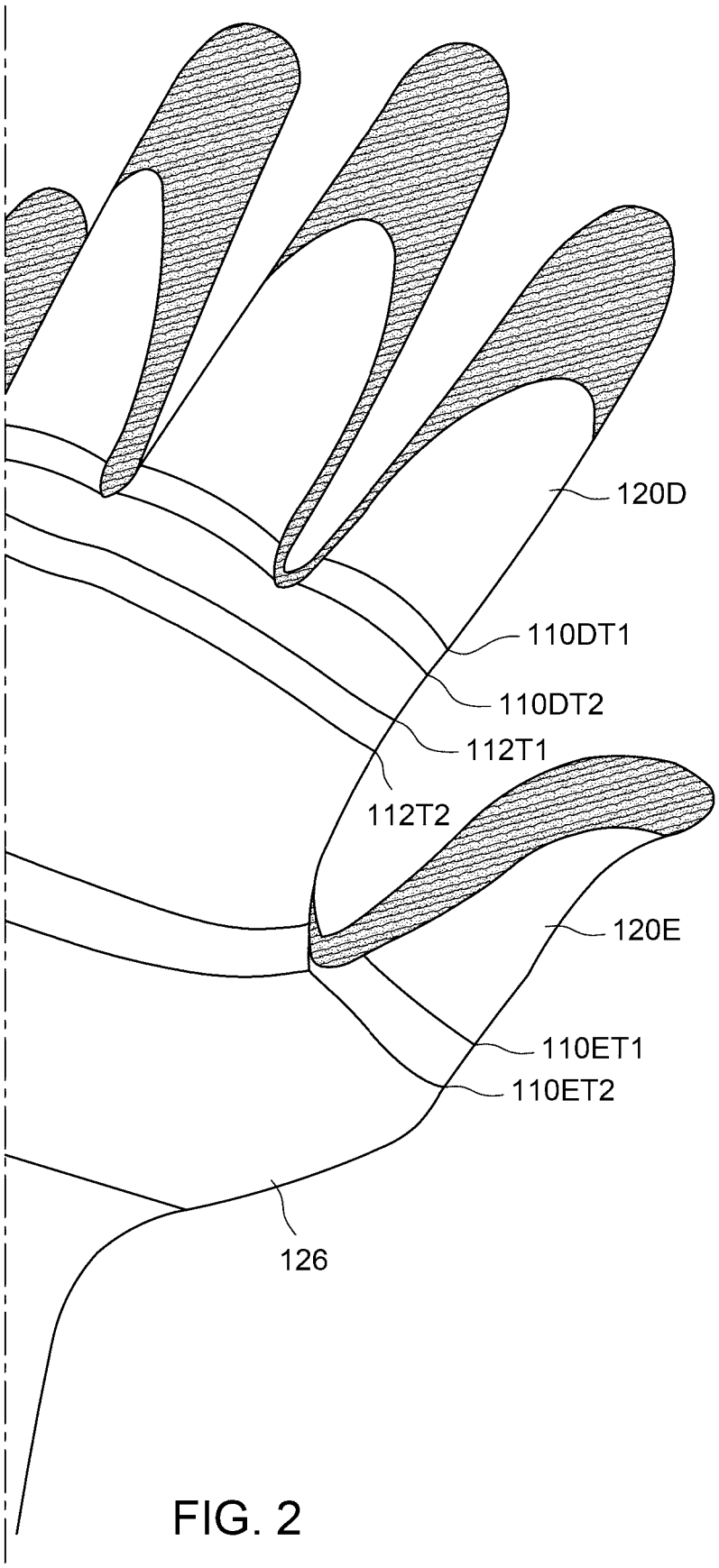
FIG. 2 is a replicates a portion of FIG. 1, except that it does not show a boundary for additional polymer coating and it shows additional tear lines.

FIG. 2 illustrates that in a tear resistant zone both boundaries (e.g., 110DT1, 110DT2; 120ET1, 120ET2) between tear susceptible zones and the tear resistant zone can be probable tear boundaries.

Where in FIG. 1 the tear resistant zones were stripes in the glove comprised mostly of tear susceptible zones, FIG. 3 shows for example that the opposite configuration can be used. In FIG. 3, zones 210A-E, 212, 214 and 216 are tear resistant zones, and zones 220A-E, 222, 224 and 226 are tear susceptible zones. Again it is the boundaries therebetween that are likely tear boundaries. While not shown, the lower zone over the wrist can be for example knitted at high density, or with another yarn.

Figure 4:
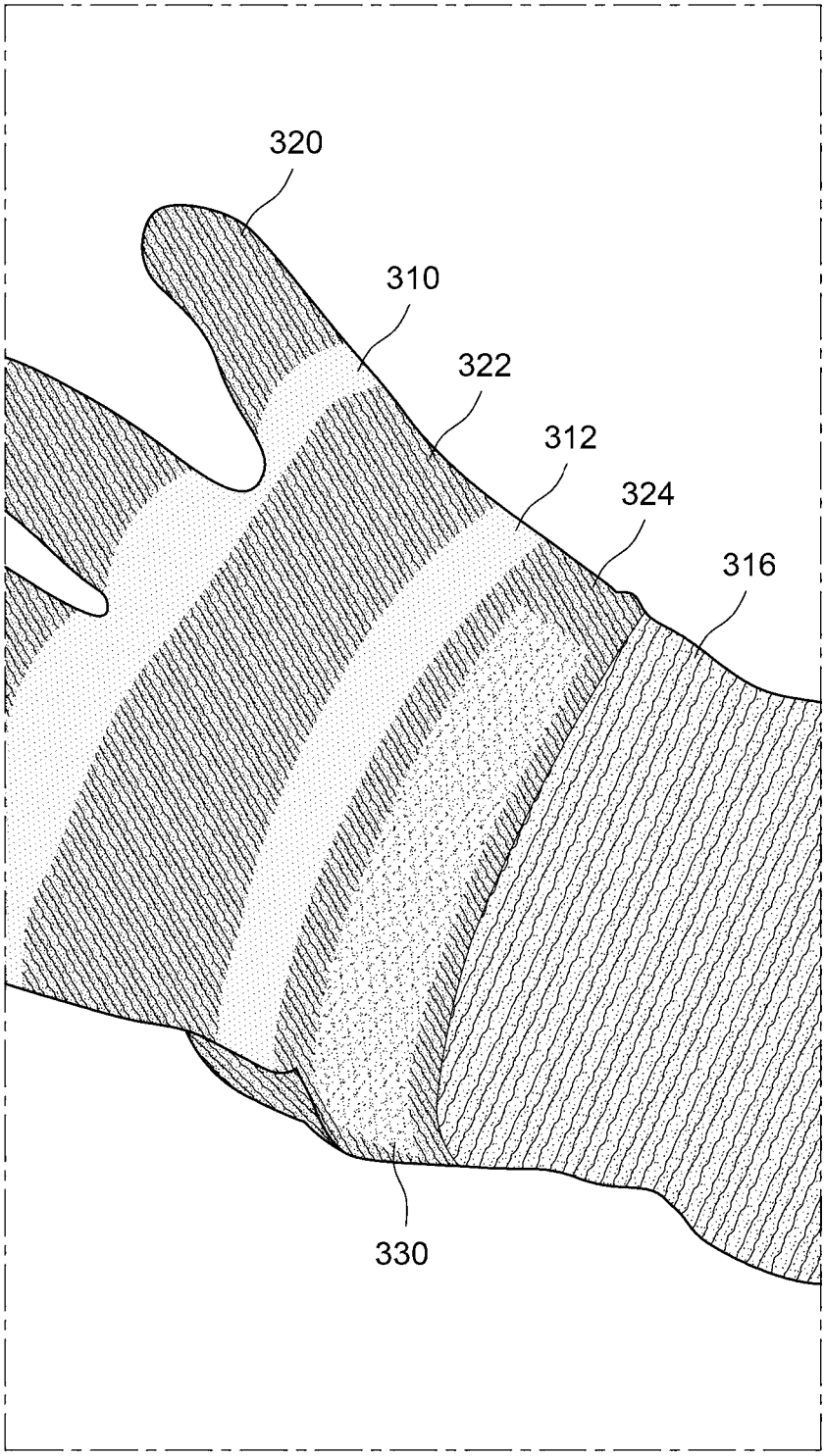
FIG. 4 illustrates still another embodiment of the invention.

FIG. 4 shows a glove with low density zones 320, 322 and 324, and with high density zone 310 and 312. There also a cuff region 316. There is further a region 330 that has been strengthened by screen printing a polymer coating. (Thumb region mostly occluded from view in this figure.)

In embodiments, the yarn includes elastic fiber such as Spandex (polyester-polyurethane copolymer). The elastic feature helps keep the glove well fitted to the hand to minimize entanglements with machinery. In embodiments, the yarn is nylon. In embodiments, the yarn is about 30 denier. In embodiments, the yarn is about 40 denier. In embodiments, the yarn is about 30 to about 40 denier. In embodiments, the yarn is about 25 to about 45 denier.

Experiments have shown that knitting the safety zone uniformly at a lower fabric density results in a glove that is too weak, and to which it is difficult to apply a polymer.

Strategic areas of the low density zones may be subject to extra stress such that they may fail too frequently. These are generally on the dorsal side. Strategic subparts of the low density zones can be strengthened, while leaving tear lines intact. This strengthening can be for example by screen printing a polymer coating, by hot stamping or otherwise applying rubber or other polymeric features onto the yarn, such as by injection molding, or the like.

In embodiments, the polymer coating is weakened to facilitate tear lines. Weakening can be by scoring, such as by mechanical scoring or scoring with focused electromagnetic energy, e.g., laser-weakening, by injection molding design, or the like. In embodiments, the polymer coating utilized is formulated to reduce its tear strength, such as by reducing polymer molecular weight, introducing low molecular weight fillers/additives, a higher amount of filler (such as an inorganic filler), or the like. Moreover, the viscosity of the polymer composition can be lowered so that a thinner polymer coating is disposed onto the liner.

The polymer coating can render the glove more resistant to unintended tear, such as during donning. Yet, without being bound by theory, it is believed that because polymer coatings can reduce the elasticity of the glove, polymer coatings can increase the effectiveness with which snagged machinery conveys force to the tear boundaries, increasing tear susceptibility.

In embodiments, the yarn is selected to have a stretch of about 1.5 to about 2.5 (over resting length).

The polymeric layers may be natural rubber latex (including Guayule latex), synthetic rubber latex, or the like, and combinations thereof. In embodiments, the polymeric layers (12, 14) are formed for example of natural rubber (NR), polychloroprene (CP), polyisoprene (PI), acrylonitrile butadiene copolymer (NBR) (such as carboxylated acrylonitrile butadiene copolymer), polyisoprene (PI), polyurethane (PU), styrene-butadiene, butyl rubber (copolymer of isobutylene with isoprene, or polymer of isobutylene), or combinations thereof. In embodiments, the elastomeric layers (12, 14) are formed of CP, NBR or combinations thereof.

These polymeric layers can be formed by aqueous dipping or by solvent dipping (e.g., for use with PU). In aqueous dipping, coagulant composition is typically applied to the fabric and dried prior to dipping. The coagulant serves to limit polymer strike-through (polymer striking through to the user's hand region).

Ansell's KVSD technology (for increasing fit), and variable plaiting technology can be utilized in the invention. Accordingly, the following U.S. Patents are incorporated herein in their entireties: U.S. Pat. Nos. 6,962,064; 7,246,509; 7,213,419; 7,434,422; 7,555,921; and 7,908,891.

Tear susceptibility can be measured with EN388 (year: 2015). The glove is clamped at the palm, and one or four (II to V) fingers, then pulled apart, with a Tensile Tester measuring the force needed. Experiments have normal nylon/PU glove takes over 400 Newtons of force to tear all four fingers off. With the gloves of the invention, a four-finger tear susceptibility of about 200 Newtons or less, or about 180 Newtons or less, or about 160 Newtons or less, or about 150 Newtons or less, or about 145 Newtons or less can be obtained. With the gloves of the invention, an index-finger tear susceptibility of about 100 Newtons or less, or about 90 Newtons or less, or about 80 Newtons or less, or about 75 Newtons or less can be obtained.

All ranges recited herein include ranges therebetween, and can be inclusive or exclusive of the endpoints. Optional included ranges are from integer values therebetween (or inclusive of one original endpoint), at the order of magnitude recited or the next smaller order of magnitude. For example, if the lower range value is 0.2, optional included endpoints can be 0.3, 0.4, . . . 1.1, 1.2, and the like, as well as 1, 2, 3 and the like; if the higher range is 8, optional included endpoints can be 7, 6, and the like, as well as 7.9, 7.8, and the like. One-sided boundaries, such as 3 or more, similarly include consistent boundaries (or ranges) starting at integer values at the recited order of magnitude or one lower. For example, 3 or more includes 4 or more, or 3.1 or more. If there are two ranges mentioned, such as about 1 to 10 and about 2 to 5, those of skill will recognize that the implied ranges of 1 to 5 and 2 to 10 are within the invention.

A laminate is a bonding, fusing, adhesion, or the like between polymer layers, or between polymer and fabric layers, such that in the range of anticipated use the laminate is a unitary structure.

Where a sentence states that its subject is found in embodiments, or in certain embodiments, or in the like, it is applicable to any embodiment in which the subject matter can be logically applied.

Specific embodiments according to the methods of the present invention will now be described in the following examples. The examples are illustrative only, and are not intended to limit the remainder of the disclosure in any way.

The invention can be further described with respect to the following numbered embodiments:

Embodiment 1

A safety glove for use on a hand with fingers with tear zones comprising: a seamless knitted liner (which can in embodiments substantially forms the glove) knitted throughout a safety zone with same yarn or mix of yarn, wherein one or more orthogonally knitted zones within the safety zone are knitted at a relatively low fabric density, wherein one or more orthogonally knitted zones within the safety zone are knitted at a relatively high fabric density, wherein the high and low density zones are configured to provide a four finger tear susceptibility of about 200 Newtons or less, wherein the safety zone includes the fingers.

Embodiment 2

A safety glove for use on a hand with fingers with tear zones comprising: a seamless knitted liner (which can in embodiments substantially forms the glove) knitted throughout a safety zone with same yarn or mix of yarn, wherein one or more orthogonally knitted zones within the safety zone are knitted with single plaiting, wherein one or more orthogonally knitted zones within the safety zone are knitted at least double plaiting, wherein the high and low density zones are configured to provide a four finger tear susceptibility of about 200 Newtons or less, wherein the safety zone includes the fingers.

Embodiment 3

The glove of a numbered Embodiment, wherein the single plaiting zones are more loosely knitted than the high plaiting zones.

Embodiment 4

The glove of a numbered Embodiment, wherein the safety zone includes the fingers through to at least a portion of a metacarpal region of the hand.

Embodiment 5

The glove of a numbered Embodiment, wherein the safety zone includes the fingers through to at least a portion of a carpal region of the hand.

Embodiment 6

The glove of a numbered Embodiment, further comprising, laminated to the glove, a coating of polymer.

Embodiment 7

The glove of numbered Embodiment 6, wherein the polymer coating is a palm coating.

Embodiment 8

The glove of numbered Embodiment 6, wherein the polymer coating is a ¾ coating.

Embodiment 9

The glove of numbered Embodiment 6, wherein the polymer coating is a full coating.

Embodiment 10

The glove of numbered Embodiment 6, wherein the polymer coating is scored along horizontal lines that are tear susceptible.

Embodiment 11

The glove of a numbered Embodiment, wherein the high density zones are about 8 mm or less in top-to-bottom width.

Embodiment 12

The glove of a numbered Embodiment, wherein from the tips of the fingers down, (a) there is a high density zone at the base of the fingers, (b) there is a high density zone from beginning at knuckles II-V, and (c) there is a high density zone in a metacarpal region, and wherein any further high density zones are further down on the hand.

Embodiment 13

A method of operating rotating machinery comprising an operator wearing a glove of one of the foregoing a numbered Embodiments.

Embodiment 14

The method of a numbered Embodiment 13, comprising the glove snagging on a rotating element of the machinery and tearing to separate a snagged portion of the glove from operator's hand.

This invention described herein is of a safety glove, methods of forming the same, and methods of using the same. Although some embodiments have been discussed above, other implementations and applications are also within the scope of the following claims. Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the following claims.

Publications and references, including but not limited to patents and patent applications, cited in this specification are herein incorporated by reference in their entirety in the entire portion cited as if each individual publication or reference were specifically and individually indicated to be incorporated by reference herein as being fully set forth. Any patent application to which this application claims priority is also incorporated by reference herein in the manner described above for publications and references.

The invention claimed is:

1. A safety glove for use on a hand with fingers comprising:

a seamless knitted liner knitted throughout a safety zone with same yarn or mix of yarn, wherein one or more orthogonally knitted zones within the safety zone are knitted with single plaiting to provide low density, wherein one or more orthogonally knitted zones within the safety zone are knitted at least double plaiting to provide high density, wherein the high and low density zones are configured to provide a four finger tear susceptibility of about 200 Newtons or less, wherein the safety zone includes the fingers through a metacarpal region of the hand, wherein the boundaries between high density and low density zones define tear boundaries, wherein there are tear boundaries at a base of fingers II through V (index to pinky), at a knuckle region of the hand, at a metacarpal region of the hand, and at a base of the thumb.

2. The glove of claim 1, wherein the safety zone includes the fingers through to at least a portion of a carpal region of the hand.

3. The glove of claim 1, further comprising, laminated to the glove, a coating of polymer.

4. The glove of claim 3, wherein the polymer coating is a palm coating.

5. The glove of claim 3, wherein the polymer coating is a ¾ coating.

6. The glove of claim 3, wherein the polymer coating is a full coating.

7. The glove of claim 3, wherein the polymer coating is scored along horizontal lines that are tear susceptible.

8. The glove of claim 1, wherein the high density zones are about 8 mm or less in top-to-bottom width.

9. The glove of claim 8, further comprising one or more tear boundaries at a carpal region of the hand or lower.

10. The glove of claim 1, wherein the single plaiting zones are more loosely knitted than the high plaiting zones.

11. A method of operating rotating machinery comprising an operator wearing a glove of claim 1.

12. The method of claim 11, comprising the glove snagging on a rotating element of the machinery and tearing to separate a snagged portion of the glove from operator's hand.

13. The glove of claim 1, configured to provide four finger tear susceptibility of 180 Newtons or less.

14. The glove of claim 1, configured to provide four finger tear susceptibility of 160 Newtons or less.

15. The glove of claim 1, configured to provide four finger tear susceptibility of 150 Newtons or less.

16. The glove of claim 1, wherein the knitted liner is knitted throughout the safety zone with the same yarn.

17. The glove of claim 3, wherein the polymer coating is more than a ¾ coating.

* * * * *